United States Patent [19]

Bogucki-Land

[11] Patent Number: 4,459,724

[45] Date of Patent: Jul. 17, 1984

[54] PILE FABRIC CUTTING APPARATUS

[75] Inventor: Bogdan Bogucki-Land, Offenbach, Fed. Rep. of Germany

[73] Assignee: Karl Mayer Textilmaschinenfabrik GmbH, Obertshausen, Fed. Rep. of Germany

[21] Appl. No.: 365,278

[22] Filed: Apr. 5, 1982

Related U.S. Application Data

[63] Continuation of Ser. No. 135,335, Mar. 31, 1980, abandoned.

[30] Foreign Application Priority Data

Apr. 9, 1979 [DE] Fed. Rep. of Germany ..... 2914245

[51] Int. Cl.[3] ..... D06C 13/10

[52] U.S. Cl. ..... 26/13; 139/291 C

[58] Field of Search ..... 26/13, 14; 139/291 C

[56] References Cited

U.S. PATENT DOCUMENTS 222,732 12/1879 Plass ..... 26/13

FOREIGN PATENT DOCUMENTS 2130782 12/1971 Fed. Rep. of Germany ..... 26/13

1446430 6/1966 France ..... 139/291 C

OTHER PUBLICATIONS

*Kettenwirk-praxis* No. 3 of 1969, Karl Mayer Textilmaschinenfabrik GmbH, West Germany, pp. 17–20.

*Primary Examiner*—Robert Mackey

*Attorney, Agent, or Firm*—Omri M. Behr

[57] ABSTRACT

A slitting apparatus for separating face-to-face pile fabrics, double plush ware or the like, into two separate panels includes a closed loop feedback arrangement that maintains equal tension on both panels thereby permitting the cutting knife to sever the double plush ware exactly in the center thereof reducing panel rejects. The feedback arrangement is of the analog type thereby insuring almost instantaneous and continuous control of the tension of both panels.

8 Claims, 3 Drawing Figures

10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
108
110
112
114
115
116
118
120
122

PRIOR ART

PILE FABRIC CUTTING APPARATUS

This application is a continuation of application Ser. No. 135,335, filed 3/31/80, now abandoned.

BACKGROUND OF THE INVENTION

1. Field of the Invention

The present invention relates to an apparatus for separating face-to-face pile fabrics, double plush ware or the like, into two separate panels, and in particular, to an apparatus which separates the ware into two separate panel with a minimum of rejects by maintaining the tension on both panels essentially equal.

2. Discussion of the Relevant Art

A plush cutting machine is disclosed in German Offenlegungsschrift No. 2,130,782, which corresponds to British Pat. No. 1,335,424 published Oct. 31, 1973. The apparatus disclosed therein includes a drive motor which directly drives the pull off rollers for one panel and drives the pull off roller for the other panel by means of a differential gear mechanism that may be incrementally advanced or retarded a fixed amount by means of an auxiliary motor when the pull off rollers are in a different rotational position with respect to each other because of uneven tension in the plush panels. The pull off rollers are oriented on both sides of the cutting knife and proximate thereto. The pull off rollers for each panel are individually affixed to the distal ends of a pair of levers which are biased by a pair of weights to provide tension on each of the panels. When the tension on the first panel varies, the pull off roller is caused to move and deflect the arm upon which it is mounted thereby activating a microswitch which energizes an auxiliary motor to increase or decrease the pull off roller of the other panel in an attempt to maintain the tension of both panels equal. However, by varying the tension on one of the pile panels, the double plush panel is moved laterally thereby displacing the center of the ware from being directly under the cutting knife causing uneven cuts in the pile height. Moreover, the correction of the relative rate of rotation of the pull off rollers occurs relatively slowly since the microswitch must first activate an auxiliary motor which then drives the correcting gear mechanism in the appropriate direction before the equalizing of tensions will occur. As disclosed, the system includes three different positions of the microswitch thus providing for incremental changes in position. Since the response time of this type of system is not continuous and is slow, several meters of unevenly cut pile ware may result. In addition, further problems arise when the pull off rollers are positioned adjacent to the cutting knife because any movement they are subjected to leads to an alteration of the cutting position. Furthermore, as disclosed, the double plush ware is fed to the cutting knife in a horizontal plane so that gravity also influences the tension on the panels. This is another factor that contributes to the uneven cutting of the pile.

Another pile cutting machine is disclosed in Kettenwirk-praxis No. 3 of 1969 at pages 17 through 20. The Kettenwirk-praxis iss a magazine published by Karl Mayer Textilmaschinenfabrik GmbH, of West Germany. The machine disclosed therein for cutting double plush ware has the ware fed vertically and upwardly towards a cutting band. On both sides of the cutting band are provided guide rollers which are mounted on a fixed axis. Reversing rollers are provided for the separated pile panels. The reversing rollers are provided with an axis of rotation that is vertically displaceable and are weight biased to provide a predetermined tension to both of the panels. Movement of the reversing rollers in the vertical plane caused by a change in the tension of the cut panels is automatically sensed and used to adjust the rate of rotation of the appropriate pull off rollers. In the embodiment disclosed, a belt drive is provided between the drive motor and the pull off roller for each of the panels which has their speed independently adjusted to maintain a constant tension on each panel. This system although superior to the apparatus hereinbefore discussed also requires a fixed amount of time to maintain equal tension on both panels so that several meters of defective material may be produced before the tension on both panels are made equal.

SUMMARY OF THE INVENTION

The present invention overcomes the shortcomings found in the prior art by providing a plush cutting machine which is capable of providing two panels with a relatively small amount of unacceptable goods.

A slitting apparatus for separating face-to-face pile fabrics, double plush ware or the like, into two panels, according to the principles of the present invention, comprises a pair of delivery means for feeding the ware. A slitting means is disposed between the delivery means for cutting the pile to form two panels. A pair of draw roller means draws a panel of ware under tension away from the slitting means. A pair of reversing means is disposed in the draw off path of each panel between the delivery means and each of the draw roller means with the position of the reversing means being responsive to the tension of each of the panels. A pair of sensing means is provided for sensing the position of each of the reversing means and a pair of braking means is utilized to brake each of the draw roller means. The braking means is responsive to each sensing means and varies the amount of braking applied to each draw roller means, thereby maintaining the tension of each of the panels approximately equal.

A method of separating face-to-face pile fabrics, double plush ware or the like into two panels, according to the principles of the present invention, comprises the steps of feeding the ware towards a cutting means centrally disposed between the ground fabric of the ware, separately drawing both panels away from the slitting means under tension with the drawing means, sensing the tension of both panels, and braking each of the drawing means in response to the tensions sensed such that the tension of each panel is maintained approximately equal.

DESCRIPTION OF THE PREFERRED EMBODIMENT

Figure 1:
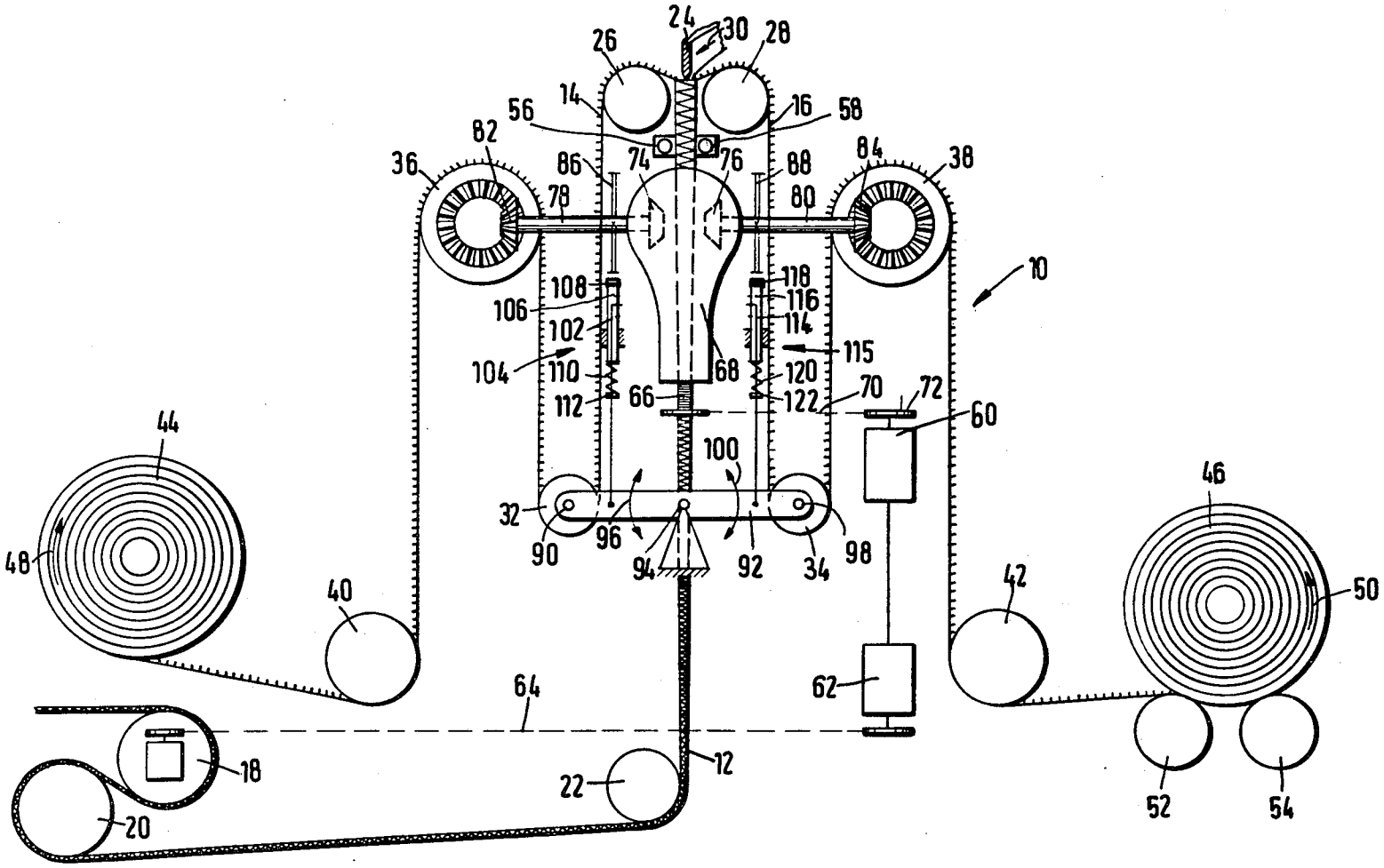
FIG. 1 shows a schematic side view of the slitting apparatus, according to the principles of the present invention.
Figure 2:
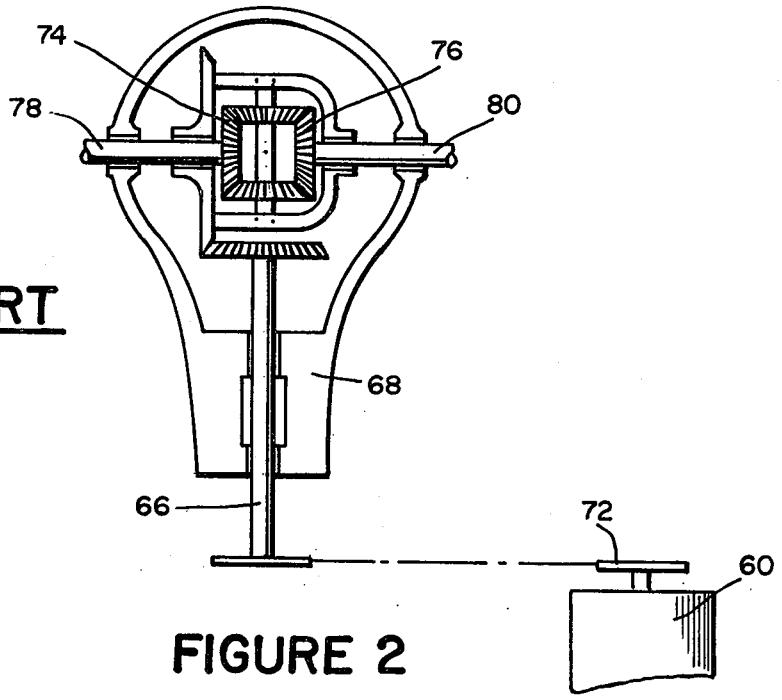
FIG. 2 is a cross-sectional view of a differential gear known in the prior art.
Figure 3:
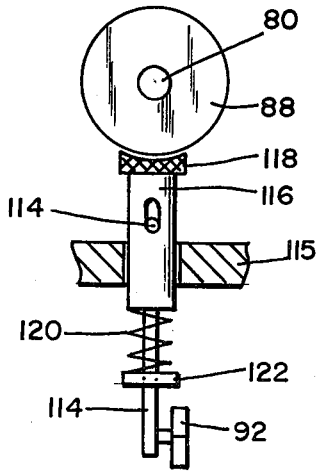
FIG. 3 is an enlarged view of the spring loaded push rod and braking mechanism utilized in the instant invention.

FIG. 1 in the drawing schematically discloses a side view of the slitting apparatus 10 for separating face-to-face pile fabrics, double plush ware 12 or the like, into two panels 14 and 16 according to the principles of the present invention. The double plush ware 12 is provided from a conventional storage arrangement, not shown, over feed rollers 18 and 20 and a guide roller 22 where it is lead in a vertical direction towards a cutting device 24, such as a band knife, for cutting the double plush ware into two equal panels 14 and 16.

On each side of the cutting device 24, delivery rollers 26 and 28 are provided over which pass the cut plush panels 14, 16 that move in a direction perpendicular to the direction of the cutting device 24 which moves in the direction of arrow 30. The cut pile panels 14 and 16 are led over reversing rollers 32 and 34, respectively, and then over draw or pull off rollers 36 and 38, respectively, and thence to further guide rollers 40 and 42, respectively, to winding drums 44 and 46, respectively. Winding drums 44 and 46 are rotated in the direction of arrows 48 and 50, respectively. Support rollers 52 and 54 drive winding drum 46 and, in a like manner, drum 44 is driven by a pair of support rollers, not shown.

All of the rollers discussed hereinbefore are provided with a fixed axis of rotation, that is to say, the axis of the roller is not permitted to move vertically or horizontally with the exception of reversing rollers 32 and 34 whose function and operation will be described in detail hereinafter.

A pair of drag compensating rollers 56 and 58 may be placed on both sides of the ware 12 proximate the cutting device 24. These rollers may be provided with spring tension to apply forces against both surfaces of the ware to compensate for the drag caused by the cutting device as it cuts the pile threads.

A drive motor 60, which is preferably a continuously adjustable direct current motor, drives at least one of the feed rollers 18 or 20 by means of a continuously adjustable ratio drive 62 and a chain drive 64 coupled thereto in a conventional manner. The drive motor 60 drives the input shaft 66 of a conventional differential drive mechanism 68 by means of a chain drive 70 operatively coupled to a pully 72 affixed on the output shaft of motor 60. The output bevel gears 74 or 76 of differential machanism 68 are connected, via output shafts 78 and 80, respectively, and bevel gears 82 and 84, respectively, to draw rollers 36 and 38, respectively. Thus, draw rollers 36 and 38 are differentially driven, in a conventional manner from a drive shaft 66 connected to the differential mechanism 68 and will have all of the characteristics associated with this type of drive mechanism.

Affixed on output shafts 78 and 80 are brake drums 86 and 88, respectively.

The axis 90 of reversing roller 32 is positioned proximate the distal end of a lever or bar 92 which is provided with a centrally disposed pivot or fulcrum point 94 about which the bar 92 may move in the direction of arrows 96. The axis 98 of reversing roller 34 is positioned at the other distal end of lever 92 and therefore is capable of moving in the direction of arrows 100. Proximate the left distal end of bar 92, the push rod 102 of a cooperating braking mechanism 104 is affixed. Push rod 102 cooperates with a telescopic tube 106 which has affixed thereon at one end a braking material 108 that is adapted to cooperate with brake drum 86 and apply braking forces thereto in a conventional manner. A spiral spring 110 is maintained in position on push rod 102 by support peg 112. The other end of spring 110 pushes against tube 106 permitting the braking material 108 to come into contact with drum 86. It is obvious that the braking forces applied to braking drum 86 are therefore directly related to the position of the axis 90 in lever or bar 92.

In a similar manner, on the righthand side of bar 92 proximate the distal end thereof, the push rod 114 of braking mechanism 115 is affixed. Push rod 114 cooperates with a telescopic tube 116 which has provided thereon braking material 118 that is adapted to cooperate with and apply braking pressure to brake drum 88. A spiral spring 120 is retained in position on push rod 114 by support peg 122 and pushes against tube 116.

With the construction just described, it is obvious that the tension of each of the cut pile panels 14 and 16 is compared by means of the lever or bar 92. If the tensions in both panels are not equal, the lever will move in the appropriate direction and the draw roller serving the panel under higher tension will immediately be caused to be braked. Because of the differential drive mechanism 68, the speed of rotation of the other draw roller will be correspondingly increased. Thus, almost simultaneously the tension in both panels will be made to become equal and the braking to both draw rollers 36 and 38 will be the same.

In operation, the double plush material 12 is provided with a predetermined supply velocity by means of the delivery rollers 18 and 20. The cut pile panels 14 and 16 are provided with a predetermined pull off velocity by means of draw rollers 36 and 38. Where a symmetrical double plush is being fabricated, this velocity should be the same for both pile panels 14 and 16 and, in general, it is preferably made slightly greater than the supply velocity in order to provide a certain amount of tension at the cutting point. The total speed of operation is provided by the continuously adjustable drive motor 16. The difference between the delivery speed and the pull off speed is provided by means of a continuously adjustable ratio drive 62.

If for any reason the tension in both of the cut plush panels 14 and 16 becomes unequal, it will lead to a dissymmetry at the cutting point and lever 92 will be displaced. If it is assumed that the plush panel 14 comes under greater tension then the following will occur. The lever 92 will be displaced in a clockwise direction causing the braking element 108 to contact braking drum 86 and apply braking pressure thereto. The draw roller 36 will thus be braked at the same time the rate of rotation of draw roller 38 is raised. In addition, the righthand plush panel 16 is simultaneously placed under greater tension by the displacement of the reversing roller 34 affixed to bar 92.

The combination of all these compensations provides an almost instantaneous and continous correction of the difference in tension between the panels so that the cutting device 24 will continue to cut in the center of the double plush ware 12. After the correction has occured, lever 92 will return to its original position. In the same manner, when the pile panel 16 comes under a higher tension, the mechanism will adjust accordingly.

It is to be noted that the device may be adjusted so that at the initial starting point no braking pressure is applied to both braking drums 86 and 88. However, the device will perform equally as well if the braking on both brake drums is adjusted so that some braking forces are equally applied to both brake drums 86 and 88.

It is also obvious to those knowledgeable in the art that this device includes the further advantage that it is possible to cut double pile ware wherein the left side and the right side are not worked in the same manner but, for example, carry different pile densities. In such a case, the two cut pile panels must be pulled off at a different rate in order to maintain them in the same degree of tension. This condition arises automatically in the present invention since the cut pile ware having the higher density always strives to attain the higher tension and thus the corresponding draw roller is continually braked with greater braking force. Also, it is possible to avoid errors caused by the incorrect loading of the reversing rollers by service personnel. The lever may be utilized with every type of pile ware whether it is carpeting material or wig material and whether the pile height is 1.5 millimeters or 3.0 millimeters in length.

Hereinbefore has been disclosed a slitting apparatus for separating face-to-face pile fabrics, double plush ware of the like, into two panels which operates in a continuous analog adjustable manner that is reliable and provides a minimum of unusable goods. It will be understood that various changes in the details, materials, arrangement of parts and operating conditions which have been herein described and illustrated by the nature of the invention may be made by those skilled in the art within the principles and scope of the present invention.

Having thus set forth the nature of the invention, what I claim is:

1. A slitting apparatus for separating face-to-face pile fabrics, double plush ware or the like, into two panels, comprising:

(a) a pair of delivery means for feeding said ware;
(b) slitting means disposed between said delivery means for cutting said pile forming two panels;
(c) a pair of draw roller means, each said roller means drawing a panel of ware under tension away from said slitting means;
(d) a pair of reversing means, each said reversing means being disposed in the draw off path to each panel between said delivery means and each said draw roller means, the position of each said reversing means being responsive to the tension of each said panel;
(e) means for causing the position of each said reversing means to be responsive to the tension of each said panel coupled to said reversing means;
(f) a pair of sensing means for sensing the position of said reversing means;
(g) a pair of braking means for braking said draw roller means, each said braking means being responsive to c respective sensing means for varying the amount of braking applied to each said draw roller means to maintain the tension of each said panel approximately equal, the position of each said reversing means being responsive to the tension of each said panel; and
(h) a source of driving power, said driving power source being operatively coupled to said draw roller means by common differential driving means.

2. The slitting apparatus according to claim 1 further including drag compensating means disposed on both sides of said ware for counteracting the drag caused by said slitting means as it slits said ware.

3. The slitting apparatus according to claim 1 wherein said delivery means is a pair of non-driven rollers disposed on either side of said slitting means.

4. A slitting apparatus for separating face-to-face pile fabrics, double plush ware and the like, into two panels, comprising:

(a) a pair of delivery means for feeding said ware;
(b) slitting means disposed between said delivery means for cutting said pile forming two panels;
(c) a pair of draw roller means, each said roller means drawing a panel of ware under tension away from said slitting means;
(d) a pair of reversing means, each said reversing means being disposed in the draw off path of each panel between said delivery means and each said draw roller means, said reversing means, including;
  (i) a bar having a centrally disposed pivot point; and
  (ii) a roller means rotatably mounted at both distal ends of said bar, each roller means receiving one of said panels under tension upon its circumference and changing the direction thereof;
(e) a pair of sensing means for sensing the position of said reversing means;
(f) a pair of braking means for braking said draw roller means, each said braking means being responsive to a respective sensing means for varying the amount of braking applied to a respective said draw roller means to maintain tension of each said panel approximately equal; and
(g) a source of driving power, said driving power source being operatively coupled to said draw roller means.

5. The slitting apparatus according to claim 4 wherein each said braking means is disposed proximate each distal end of said bar and applies braking forces responsive to the position of said bar.

6. A slitting apparatus for separating face-to-face pile fabrics, double plush ware and the like, into two panels, comprising:

(a) a pair of delivery means for feeding said ware;
(b) slitting means disposed between said delivery means for cutting said pile forming two panels;
(c) a pair of draw rollers means, each said roller means drawing a panel of ware under tension away from said slitting means;
(d) a pair of reversing means, each said reversing means being disposed in the draw off path of each panel between said delivery means and each said draw roller means;
(e) means for causing the position of each said reversing means to be responsive to the tension of each of said panel coupled to said reversing means;
(f) a pair of sensing means for sensing the position of said reversing means;
(g) a pair of braking means for braking said draw roller means, each said braking means being responsive to a respective sensing means for varying the amount of braking applied to a respective said draw roller means to maintain the tension of each said panel approximately equal; and
(h) a source of driving power, said driving power source being operatively coupled to said draw roller means by differential drive means including a differential mechanism having a pair of output shafts, said output shafts including means for receiving breaking forces applied thereto.

7. A slitting apparatus for separating face-to-face pile fabrics double plush ware and the like, into two panels, comprising:

(a) a pair of delivery means for feeding said ware;
(b) slitting means disposed between said delivery means for cutting said pile forming two panels;

(c) a pair of draw roller means each said roller means drawing a panel of ware under tension away from said slitting means (d) a pair of reversing means, said reversing means includes a bar having a centrally disposed pivot point, and a roller means rotatably mounted at both distal ends of said bar, each roller means receiving one of said panels under tension upon its circumference and changing the direction thereof, each said reversing means being disposed in the draw off path of each panel between said delivery means and each said draw roller means;

(e) a pair of sensing means for sensing the position of said reversing means;

(f) a pair of braking means being responsive to a respective sensing means for varying the amount of braking applied to a respective said draw roller means to maintain the tension of each said panel approximately equal; and (g) a source of driving power, said source of driving power being operatively coupled to said draw roller means by a differential driving means, said driving means including a differential mechanism having a pair of output shafts, one of said shafts being coupled to a respective draw roller, said output shafts including means for receiving braking forces from said braking means responsive to the position of said bar.

8. A slitting apparatus for separating face-to-face pile fabrics, double plush ware or the like, into two panels, comprising:

(a) a pair of delivery means for feeding said ware;

(b) slitting means disposed between said delivery means for cutting said pile forming two panels;

(c) a pair of draw roller means each said roller means drawing a panel of ware under tension away from said slitting means;

(d) a pair of reversing means, each said reversing means being disposed in the draw off path of each panel between said deliver means and each said draw roller means;

(e) a pair of sensing means for sensing the position of said reversing means;

(f) a pair of braking means for braking said draw roller means including a central pivoted braking bar, said braking bar having said reversing means mounted on the distal ends thereof, being operatively coupled to each said panel by the distal end of said bar in order that said braking forces are increased on one of said draw roller means while being simultaneously decreased on the other of said draw roller means;

(g) a source of driving power, said driving power source being operatively coupled to said draw roller means.

* * * * *